US005254062A

United States Patent [19]

Hoffman

[11] Patent Number: 5,254,062

[45] Date of Patent: Oct. 19, 1993

[54] KARATE KICK-BOARD TARGET

[75] Inventor: Daniel Hoffman, Maplewood, N.J.

[73] Assignee: The Chestnut Group, Inc., Newton, Mass.

[21] Appl. No.: 967,559

[22] Filed: Oct. 27, 1992

Related U.S. Application Data

[63] Continuation of Ser. No. 665,649, Feb. 25, 1991, abandoned.

[51] Int. Cl.[5] ..... A63B 69/34

[52] U.S. Cl. ..... 482/83; 482/87

[58] Field of Search ..... 273/67 R, 67 B, 76, 273/78, 26 R, 177 A, 181 J, 482, 181 C, 181 B, 317, 404; 428/119, 120, 100; 482/83-90, 148, 209, 121, 129, DIG. 4, DIG. 5, 904

[56] References Cited

U.S. PATENT DOCUMENTS

| | | | |
|---|---|---|---|
| 2,919,133 | 12/1959 | Eggers | 272/66 |
| 3,304,089 | 3/1964 | Smith . | |
| 3,377,064 | 4/1968 | Hudson et al. . | |
| 3,484,331 | 12/1969 | Betz | 428/120 |
| 3,885,768 | 5/1975 | Frye | 428/100 |
| 4,004,799 | 1/1977 | Kundert . | |
| 4,084,811 | 4/1978 | Kyo | 272/76 |
| 4,171,803 | 10/1979 | Smith . | |
| 4,172,749 | 10/1979 | Liggett | 428/119 |
| 4,572,504 | 2/1986 | DiBartoto | 272/76 |
| 4,653,582 | 3/1987 | Ehrenfriece | 272/76 |
| 4,653,746 | 3/1987 | Brunier . | |
| 4,662,630 | 5/1987 | Dignard | 272/78 |
| 4,787,625 | 11/1988 | Chaloux | 272/76 |
| 4,817,941 | 4/1989 | McCurry | 222/76 |
| 4,913,419 | 4/1990 | McAuliffe | 272/76 |
| 4,946,527 | 8/1990 | Battrell | 428/120 |
| 4,953,852 | 9/1990 | Donohue | 272/78 |
| 4,973,045 | 11/1990 | Herberer | 272/76 |

FOREIGN PATENT DOCUMENTS

| | | | |
|---|---|---|---|
| 1242704 | 8/1971 | United Kingdom | 273/76 |

OTHER PUBLICATIONS

Black Belt Feb. 1987. Kyeo Kpah Ki.
Black Belt Feb. 1987 Action Kick Board.

*Primary Examiner*—Richard J. Apley
*Assistant Examiner*—Jerome Donnelly
*Attorney, Agent, or Firm*—Wolf, Greenfield & Sacks

[57] ABSTRACT

In a preferred embodiment, a karate kick-board target member including an elongated sheet member at-least about five inches wide and at-least about seven inches long, sufficiently rigid to maintain linear shape against gravity when supported uprightly, laterally or horizontally, having sufficient flexibility and resiliency to be resiliently bendable and thereby resistant to breaking responsive to major force struck thereagainst, the sheet member including a first linearly-extending plastic sheet having first forward and rearward opposite faces and including a second linearly-extending plastic sheet having second forward and rearward opposite faces, spaced-apart flanges being mounted on and secured between at-least one of the first forward and rearward faces and at-least one of the second forward and rearward faces with the flanges extending substantially perpendicularly to at-least the faces on which they are mounted. The sheet member is secured to a rigid support member and a pair of suction cups include axially extending necks which engage the support member at spaced positions. The cups are shaped to engage a surface at any of a plurality of positions. The target member flexes, in response to blows to the sheet member, at the sheet member, and the necks of the suction cups.

7 Claims, 3 Drawing Sheets

KARATE KICK-BOARD TARGET

This application is a continuation of application Ser. No. 07/665,649, filed Feb. 25, 1991 now abandoned.

This invention is directed to a karate kick-board target.

PRIOR ART

No relevant prior art is known except typical cut-out cardboard sometimes used, together with its limitations of being easily destructable and substantially less durable than desirable, against the Force of strikes by the hand and/or kicks by a foot was found not is known. No relevant prior art was found in a novelty patent search, the sole art of interest being as follows. Kundert U.S. Pat. No. 4,004,799, granted Jan. 25, 1977, is directed to a hand-separable board composed of two separate portions keyed-together by releasable keys endurable of predetermined amount of striking force before parting. Brunier U.S. Pat. No. 4,653,746, granted Mar. 31, 1987, discloses a padded bag suspended from a spring-embodying overhead support. Hudson et al. U.S. Pat. No. 3,377,064, granted Apr. 9, 1968, is directed to a football trainer padded elongated member each mounted against rearwardly movement thereof by a mounting spring resiliently pressing the padded elongate member to a forward position of rest. Equally unrelated is the Smith U.S. Pat. No. 4,171,803, granted Oct. 23, 1979, disclosing another karate breaking board, in which two members are secured together to withstand up to a predetermined maxima striking force.

BACKGROUND TO THE INVENTION

Prior to the present invention, as above-noted, in the absence of having anything clearly suitable from the standpoint of being durably long lasting in use as a karate kick-board, and yet not of a nature that would present dangerous jagged and/or sharp edges or the like if broken, and which is of inexpensive material and/or cost for initial purchase and occasional replacement, heretofore typically pieces of cut-out card-board have been used in spite of the initial reasonably acceptable slight flexibility but low durability to destruction when subjected to one or more striking-blows of a karate foot-kick or karate hand-strike, or the like. Also, typically with such resatisfactory card board pieces, another person was endangered by the hazardous task in hand-holding the card-board piece at the desired position and/or location and/or height in close proximity to the repeated striking blows or impacts of the foot or hand of the karate-practicing person. As evidenced from the above-discussed prior art, there has not existed heretofore any suitable karate kick-board target, the subject matter of this invention.

OBJECTS OF THE INVENTION

Objects of the invention include the obtaining of a novel target overcoming and/or avoiding of problems and difficulties and disadvantages and dangers or hazards of the types above-discussed.

Another object is to obtain a novel target that is not brittle nor fragile to striking blow to be inflicted to flat or substantially-flat face surface(s) thereof.

Another object is to obtain a novel target that is durably resistant to repeated violent blow impacted against flat or substantially flat-faced surface(s).

Another object is to obtain a novel target having a combination of sufficient rigidity and flexibility and/or flexibility as to reduce potential injury to the foot and/or hand when striking a karate hand-strike or foot-kick against surface(s) of the target onto its flat and/or substantially flat surface(s).

Another object is to obtain a novel target having a combination of sufficient rigidity and flexibility and/or flexibility as to prevent and/or reduce the probability of a breaking and/or cracking and/or shattering of the target when struck on its flat or substantially flat surface(s).

Another object is to obtain a novel target made of novelly-selected structure and structural arrangements as to have a high level of toughness and/or durability to compression and/or destruction and/or irreparable damage to its structure and future utility as a target, particularly in the field of karate struck on its flat or substantially flat surface(s).

Another object is to obtain a novel target, together with one or more foregoing objects, that has sufficient flexible resiliency as to snap-back to its original position and normal shape and structure, immediatly following being struck by an intensive strike or blow by a hand or kick such as typically imparted to a karate target.

Another object is to obtain a novel target having a structure and composition characterized by non-shattering characteristics during and/or following an intensive strike or blow by a hand or kick such as typically imparted to a karate target.

Another object is to obtain a novel target having a structure and composition not subject to breaking into sharp and/or pointed and/or pointed portions that could constitute a hazard to injury of or to a person during and/or following an intensive strike or blow by a hand or kick such as typically imparted to a karate target.

Another object is to obtain a novel target of simple and easy manufacture and/or of low cost, suitable for fulfilling one or more of preceding objects.

Another object is to obtain a novel target providing a self-support capability for floor, walls or the like.

Another object is to obtain a novel target providing improved hand-grasping capability characterized by reducing hazards of potential injury when the novel target of one or more preceding objects is struck during and/or following an intensive strike or blow by a hand or kick such as typically imparted to a karate target.

Another object is to obtain a novel target achieving one or more of preceding objects, characterized by being intermittently detachably attachable and/or anchorable on any of a variety of surfaces such as a wall, a floor, and the like.

Another object is to obtain a novel target having improved holding to a mounting surface together with achieving one or more of preceding objects, characterized by being intermittently detachably attachable and/or anchorable on any of a variety of surfaces such as a wall, a floor, and the like.

Another object is to obtain a novel target inclusive of intermediate mounting structure adapted to detachably intermittently mount on rough-surfaced faces and/or object; with sufficient fastness (holding power) as to endure and remain mounted in its support function during and/or following an intensive strike or blow by a hand or kick such as typically imparted to a karate target.

Another object is to obtain a novel target achieving one or more of preceding objects, together with being of a size and/or shape and/or composition and/or weight and/or mountability and/or intermittent detachability as to facilitate easy handling and/or mounting and/or positioning for maximum effectiveness in height and/or orientation as associated with strike in/during contemplated use such as typically contemplated intensive strikes or blows by a hand or kick such as imparted to a karate target.

Another object is to obtain a novel target adaptable for use in a variety of sports that would benefit from the present inventive target, such as in the sport of La Cross in which a ball strikes a target, backboard in basketball, and the like.

Other objects become apparent from the preceding and following disclosure.

SUMMARY OF THE INVENTION

The invention may be broadly described as a target member, as a combination, including an elongated sheet member having a shape inclusive of a linear length and a linearly-extending length, and support structure with its associated mechanism. The sheet member is sufficiently rigid as to substantially maintain the above-noted linear shape against gravitational pull when supported uprightly or laterally or horizontally. The sheet member has a minor degree of flexibility and resiliency such that the sheet member is resiliently bendable along each of the above-noted shape of its width and length dimensions whereby the sheet member is resistant to readily breaking responsive to the major force. The sheet member includes at-least a first linearly-extending plastic sheet having first forward and rearward opposite faces, at-least one of the first forward and rearward faces having spaced-apart flanges extending substantially perpendicularly to at-least one of the forward and rearward faces such that support-structure is provided thereto. The sheet member has opposite ends and opposite side-edges and includes support structure and associated mechanism thereof for supporting at-least one of the opposite ends and opposite side edges such that the sheet member is supportable at any of upright, lateral or horizontal positions.

In a first preferred embodiment of the above-described broad invention, the sheet member includes a second linearly-extending sheet having second forward and rearward opposite faces. The spaced-apart flanges are mounted on and secured between at-least one of the first forward and rearward faces and at-least one of the second forward and rearward faces.

In a second preferred embodiment as an improvement on the first preferred embodiment, the first and second sheets are each of plastic composition such as set-forth below and/or polyurethane or the like such that the sheet thereof is strong but somewhat resilient nature.

In a third preferred embodiment as an improvement on the second preferred embodiment, the support structure and associated mechanism include structure forming a through-space aperture receivable of at-least one finger.

In a fourth preferred embodiment as an improvement on the third preferred embodiment, the support structure and associated mechanism include structure forming at-least one through-space aperture such that the sheet member is graspable therethrough by a plurality of fingers.

In a fifth preferred embodiment as an improvement on the fourth preferred embodiment, the support structure and associated mechanism include a plurality of through-space apertures positioned such that the sheet member is graspable therethrough by a plurality of fingers.

In a sixth preferred embodiment as an improvement on the second preferred embodiment, the support structure and associated mechanism include at-least one separate substantially rigid support structure, the substantially rigid support structure and the sheet member being each adapted for rigidly mounting one thereof on the other thereof.

In a seventh preferred embodiment as an improvement on the sixth preferred embodiment, the at-least one substantially rigid support structure includes attaching structure and associated mechanism for detachably attaching to at-least one of a floor upper surface, a wall surface upright surface, a post, a pole, a furniture horizontal or upright surface and an intermediate mounting member mounted on one thereof.

In a eigthth preferred embodiment as an improvement on the seventh preferred embodiment, the support structure and associated mechanism include at-least one suction cup extending from and mounted on the rigid support structure positioned to be suction mountable on the floor upper surface, a post, a pole, a furniture horizontal or upright surface and an intermediate member mounted on one thereof.

In a nineth preferred embodiment as an improvement on the seventh preferred embodiment, the support structure and associated mechanism include at-least two of the suction cups mounted on the support structure in spaced-apart relationship.

In a tenth preferred embodiment as an improvement on the nineth preferred embodiment, there is included an intermediate mounting member having opposite substantially intermediate-member flat faces, at least one of the intermediate flat faces having sufficiently smooth surface as to be securely and retainably mountable thereon of the suction cups, a remaining one of the substantially intermediate-member flat faces including rough-surface mounting structure and associated mechanism for mounting on roughed surfaces.

In an eleventh preferred embodiment as an improvement on the second preferred embodiment, the support structure and associated mechanism include at-least one separate substantially rigid support structure, the substantially rigid support structure and the sheet member being each adapted for rigidly mounting one thereof on the other thereof, the at-least.

In a twelfth preferred embodiment as an improvement on the second preferred embodiment, the elongated sheet member includes aperture-structure forming at-least one through-space aperture such that the sheet member is graspable therethrough by a plurality of fingers.

In a thirteenth preferred embodiment as an improvement on the twelfth preferred embodiment, the elongated sheet includes a plurality of through-space apertures positioned such that the sheet member is graspable therethrough by a plurality of fingers.

In a fourteenth preferred embodiment as an improvement on the twelfth preferred embodiment, the elongated sheet member includes aperture-structure forming at-least one through-space aperture such that the sheet member is graspable therethrough by a plurality of fingers.

In a fifteenth preferred embodiment as an improvement on the thirteenth preferred embodiment, the elongated sheet includes a plurality of through-space apertures positioned such that the sheet member is graspable therethrough by a plurality of fingers.

In a sixteenth preferred embodiment as an improvement on the seventh preferred embodiment, the support structure and associated mechanism includes at-least one clamping structure and associated mechanism mounted on the elongated sheet, for clamping onto a support or anchoring member.

In a seventeenth preferred embodiment as an improvement on the eighth preferred embodiment, at-least one of the suction cup includes a lever structure and associated mechanism for withdrawing a central portion of the suction cup such that the suction cup by increases suction against a surface on which mounted.

In an eighteenth preferred embodiment as an improvement on the ninth preferred embodiment, at-least one of the suction cup includes a lever structure and associated mechanism for withdrawing a central portion of the suction cup such that the suction cup by increases suction against a surface on which mounted.

In a nineteenth preferred embodiment as an improvement on the eighteenth preferred embodiment, the sheet member has a width-portion having and extending along a width linear axis with width dimension of at-least about, five inches at a widest location thereof and has a length-portion, extending along a length linear axis with a length dimension of about seven inches at most length-wise portion thereof.

In a twentieth preferred embodiment as an improvement on the first broadly-described invention, the sheet member has a width-portion having and extending along a width linear axis with width dimension of at-least about five inches at a widest location thereof and has a length-portion extending along a length linear axis with a length dimension of about seven inches at most length-wise portion thereof.

In a twenty-first preferred embodiment as an improvement on the first-described broad invention, the support structure and associated mechanism include structure forming a through-space aperture receivable of at-least one finger.

In a twenty-second preferred embodiment as an improvement on the first-described broad invention, the support structure and associated mechanism include structure forming at-least one through-space aperture such that the sheet member is graspable therethrough by a plurality of fingers.

In a twenty-third preferred embodiment as an improvement on the twentieth preferred embodiment, the support structure and associated mechanism include a plurality of through-space apertures positioned such that the sheet member is graspable therethrough by a plurality of fingers.

In a twenty-fourth preferred embodiment as an improvement on the first broadly-described invention, the support structure and associated mechanism include at-least one separate substantially rigid support structure, and the substantially rigid support structure and the sheet member being each adapted for rigidly mounting one thereof on the other thereof.

In a twenty-fifth preferred embodiment as an improvement on the first-described broad invention, at-least one substantially rigid support structure includes attaching structure and associated mechanism for detachably attaching to at-least one of a floor upper surface, a wall surface upright surface, a post, a pole, a furniture horizontal or upright surface and there being also included an intermediate mounting member mounted on one of the wall, floor, or the like.

In a twenty-sixth preferred embodiment as an improvement on the twenty-third preferred embodiment, the support structure and associated mechanism include at-least one suction cup extending from and mounted on the rigid support structure positioned to be suction mountable on the floor upper surface, a post, a pole, a furniture horizontal or upright surface and an intermediate member mounted on one thereof.

In a twenty-seventh preferred embodiment as an improvement on the twenty-fourth preferred embodiment, the support structure and associated mechanism include at-least two of the suction cups mounted on the support structure in spaced-apart relationship.

In a twenty-eighth preferred embodiment as an improvement on the twenty-seventh preferred embodiment, there is included an intermediate mounting member having opposite substantially intermediate-member flat faces, and at-least one of the intermediate flat faces has sufficiently smooth surface as to be securely and retainably mountable thereon of the suction cups, and a remaining one of the substantially intermediate-member flat faces includes rough-surface mounting structure and associated mechanism for mounting on rough surfaces.

In a twenty-ninth preferred embodiment as an improvement on the broad invention firstdescribed above, the support structure and associated mechanism include at-least one separate substantially rigid support structure, the substantially rigid support structure and the sheet member being each adapted for rigidly mounting one thereof on the other thereof, the at-least.

In a thirtieth preferred embodiment as an improvement on the broad invention first described above, the elongated sheet member includes aperture-structure forming at-least one through-space aperture such that the sheet member is graspable therethrough by a plurality of fingers.

In a thirty-first preferred embodiment as an improvement on the twenty-first embodiment, the elongated sheet includes a plurality of through-space apertures positioned such that the sheet member is graspable therethrough by a plurality of fingers.

In a thirty-first preferred embodiment as an improvement on the twenty-first embodiment, the elongated sheet includes a plurality of through-space apertures positioned such that the sheet member is graspable therethrough by a plurality of fingers.

In a thirty-second preferred embodiment as an improvement on the twenty-eighth preferred embodiment, the elongated sheet member includes aperture-structure forming at-least one through-space aperture such that the sheet member is graspable therethrough by a plurality of fingers.

In a thirty-third preferred embodiment as an improvement on the twenty-ninth preferred embodiment, the elongated sheet includes a plurality of through-space apertures positioned such that the sheet member is graspable therethrough by a plurality of fingers.

In a thirty-fourth preferred embodiment as an improvement on the twenty third, the support structure and associated mechanism includes at-least one clamping structure and associated mechanism mounted on the elongated sheet, for clamping onto a support or anchoring member.

The invention may be better understood by making reference to the following Figures.

THE FIGURES

FIG. 1 diagrammatically illustrates a front elevation plan view of a preferred embodiment of the inventive target member, the front and back views being mirror-image identical for features thereof.

Figure 1:
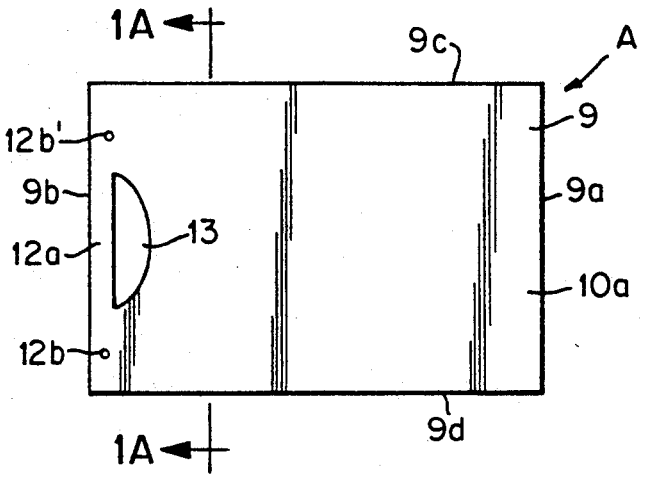
FIG. 1A illustrates a diagrammatic in-part view in cross-section, of a target board such as illustrated in FIG. 1 and other preferred embodiments illustrated in following Figures, as taken along line 1A—1A of FIG. 1.
Figure 2:
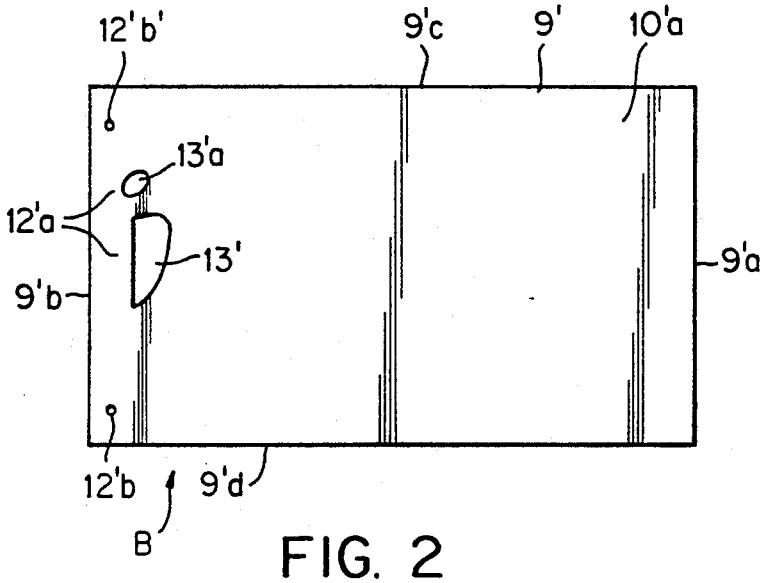
FIG. 2 illustrates a diagrammatic a front elevation plan view of an alternate preferred embodiment of the inventive target member, the front and back views being mirror-image identical for features thereof.
Figure 3:
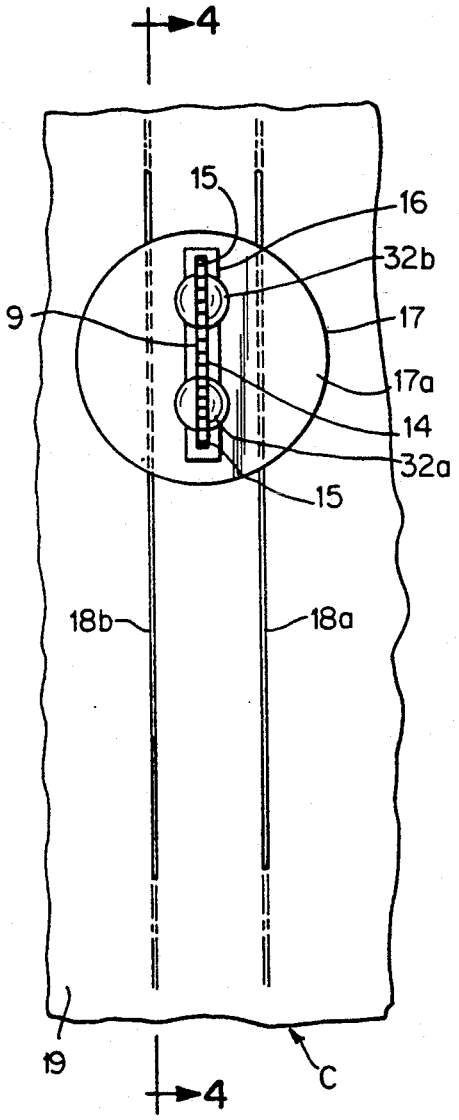

FIG. 3 illustrates a diagrammatic view of another preferred combination of the inventive target combination being shown mounted on a flat wall having a rough surface, inclusive of one of embodiments such as typically FIG. 1 or FIG. 2, but inclusive of other combination elements such as spaced-apart uprightly extending tape structures on which a disk is detachably mounted, a flat face of the mounted disk being shown with suction cups mounted thereon, the suction cups having mounted thereto a rigid support member having mounted within a slot thereof a target sheet member extending laterally outwardly therefrom.

Figure 4:
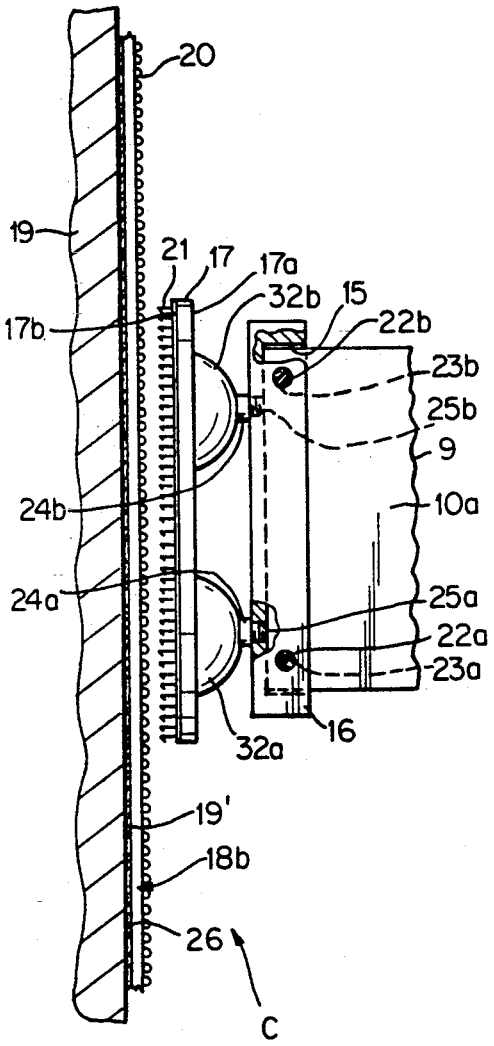

FIG. 4 illustrates the same preferred embodiment as FIG. 3, as viewed along line 4—4 of FIG. 3, in an exploded view thereof with the male-fastening hook-members mounted on a back face of the plastic disk, being shown (exploded view) spaced-from the female loop-members mounted on an exposed (outer) face of a tape having an adheasive-type back-side coating adhered to the roughened surface of a wall.

Figure 5:
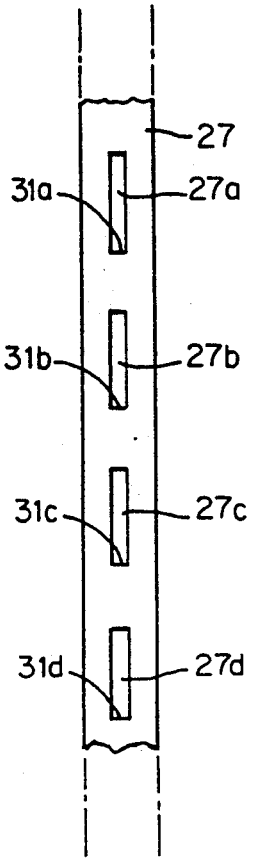

FIG. 5 diagrammatically illustrates an element of another preferred target combination, here illustrating a slotted elongated uprightly-mountable member in a front view thereof, adapted to receive hook members on which a rigid support member is mounted, with a target sheet member would be mounted by the rigid support member.

Figure 6:
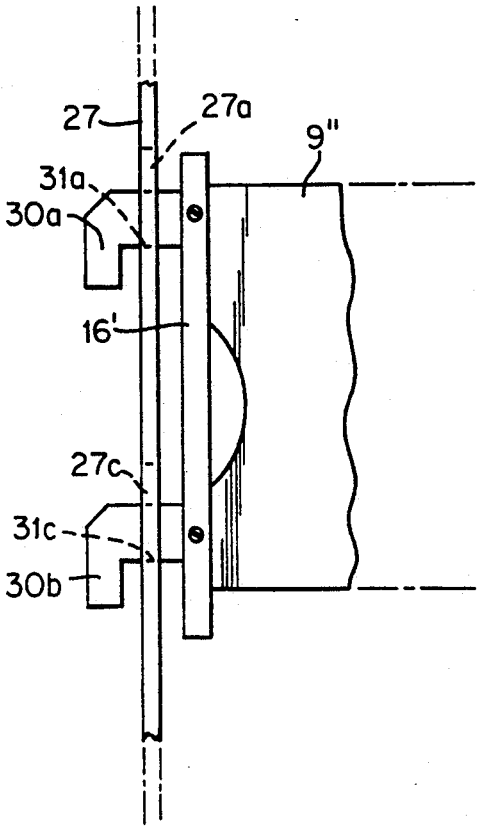

FIG. 6 diagrammatically illustrates a side view of the element of FIG. 5, but also showing in a fastened (hooked-on) view the above-noted hook members that mount and again illustrate the above-noted rigid support member that mounts the target sheet member that is shown in an in-part view thereof.

Figure 7:
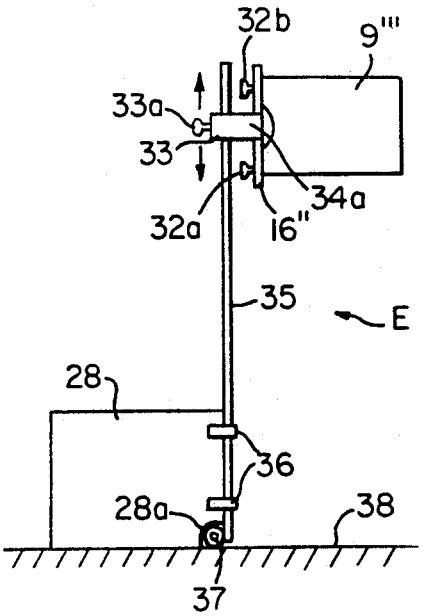

FIG. 7 diagrammatically illustrates a side view with cross-section of the supporting floor, an alternate other preferred embodiment of an upright rod mounting a bottom weighted member, with tilt roller(s) attached at the bottom for transporting to different sites, with an upwardly and downwardly alternately adjustable clamp on the rod, with the clamp being clamp-mounted onto an above-noted rigid support member that mounts the target sheet member.

Figure 8:
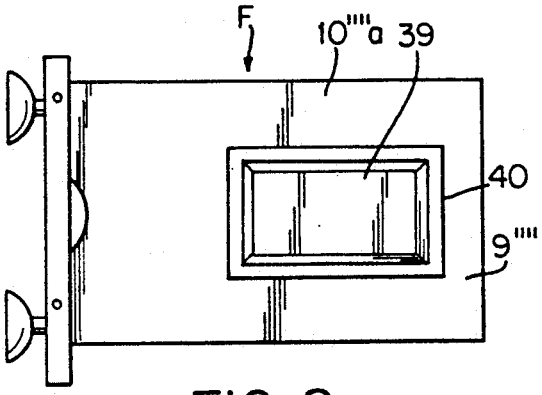

FIG. 8 diagrammatically illustrates another alternate preferred embodiment additionally illustrating mounted on and/or embedded-within the target sheet's front face a cushion member representative of a front view of an inflated plastic envelope enclosing sufficient compressed gas as to render the envelope surface resilient to mass(es) striking the outer exposed surface of the inflated envelope.

DETAILED DESCRIPTION

To the extent that one or more of the following figures illustrate embodiments and/or elements previously described for another embodiment, previously described, related indicia are utilized and their function is/are not redescribed, except in instances to improve clarity and/or understanding.

In FIG. 1, the target sheet member A, inclusive of a plastic-composition first linear sheet 9 has opposite end portions 9a and 9b and edges thereof and opposite top and bottom portions 9c and 9d and edges thereof, and its forward face or surface 10a, with the hand-graspable support structure 12a formed by the finger's gripping through-aperture or hole 13 as well as the female bolt-receivable aperture or holes 12b and 12b'.

Figure 1A:
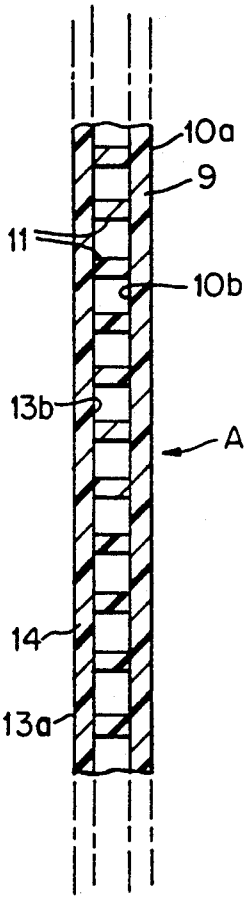

FIG. 1A illustrates the same embodiment as FIG. 1, and further illustrates the first linear sheet 9 and its forward surface 10a, additionally showing the rearward face 10b thereof mounting the spaced-apart plastic flanges 11. The flanges 11 at their opposite ends mount the rearward (inside) face or surface 13b of the plastic-composition second linear sheet 14 having its forward (outer) face or surface 13a.

FIG. 2 illustrates another alternate preferred embodiment having target sheet member B, substantially corresponding to that of FIG. 1 sheet member A, except additionally embodying a thumb-receiving second hole or aperture 13'a and the finger(s) mounting aperture or hole 13' here illustrated as being of a different shape to permit a different hand position that utilizes concurrently the thumb-receiving second aperture. In the embodiments shown in FIGS. 1 and 2, the target sheet member is intended to be hand-held. The sheet member flexes in response to blows from a users foot, arm or other.

FIG. 3 illustrates an alternate other embodiment C having the target sheet member C, with target combination plastic-composition first linear sheet 9 and target combination plastic-composition second linear sheet 14 previously described for typically embodiment A (or likewise for embodiment B, for example), mounted within the a slot (and slot-space thereof) 15 at a front side of rigid support member 16 and bolted thereto with bolts 22a and 22b extending through holes 23a and 23b, respectively. Mounted on the rear side the rigid support member are the suction cups 32a and 32b. The spaced-apart suction cups 32a and 32b are here illustrated as detachably mounted on an intermediate member including the disc 17, on the disc's upper surface 17a, with the disc being detachably mounted on and between the spaced-apart upright strips or tapes 18a and 18b that are each mounted on a wall 19 having wall rough-surface 19' to which the suction cups would not hold fastly. The suction cups 32a and 32b include axially extending cylindrical neck members 24a and 24b respectively which also flex in response to blows to the sheet member. The suction cups, however, are sturdy enough to maintain secured attachment to the base during flexure of the neck members.

FIG. 4 continuing to illustrate the alternate preferred embodiment C, in addition to features previously described, illustrates those features in this side view and wall cross-sectional in-part view. Additionally, the tapes 18a and 18b, as here illustrated for tape 18b, each include tape-mounted female detachable loops 20, detachably securable to the male hooks 21 mounted on the rearward face 21 of the disc 17. The tape 18b includes suitable wall-mounting member(s) and/or adhesive composition such as screws (not illustrated) and/or adhesive layer or coating 26. The rigid support member securely anchors the Target composite structure A (of FIG. 1A) within the slot 15 by the bolt or screws 22*a* and 22*b* passing through holes (threaded, if for a screw) 23*a* and 23*b*. The suction cups's mounting shafts are typically male-threaded and screw-mounted within female-threaded holes (receptacles) 25*a* and 25*b*, as better shown in the cut-away revealing in-part cross-section of hole 25*a*.

FIG. 5 illustrates a front view of typically a strong plastic or metal bracket 27 in strip or elongated form for upright mounting thereof between upper and lower supports (not shown) and/or on a weighted or secured base member 28 such that as shown in FIG. 7. The bracket 27 has a forward surface through which through-space slots 27*a*, 27*b*, 27*c*, 27*d* and the like pass, for receipt of male hook-like members 30*a*, 30*b* and the like (shown in FIG. 6) pass to be hooked on structure of the lower edges 31*a*, 31*b*, 31*c*, 31*d* and the like.

FIG. 6 for an alternate embodiment D, illustrates an in-part view of a first linear sheet 9''' mounted by a rigid support member 16' sucurely and rigidly-mounting above-noted hook-like members 30*a* and 30*b* shown fastened securely within the through-space slots 31*a* and 31*b* illustrated above in FIG. 5.

FIG. 7 illustrates another alternate embodiment E in which the rigid support member 16'' is rigidly mounted by a screw-tightening clamp 34*a* by clamp-tightening screws 32*a* and 32*b*, with the clamp 34 second clamp 33 secured by a male clamp screw 33*a*, the clamp 33 being slideably mounted for intermittent loosening and slidably adjusting to higher or lower locations on the mounted upright rod 35. It is contemplated that the clamp 34*a* may be swivelly mounted onto the claw 33 together with an appropriate conventional locking device (lever, not illustrated) to lock to a desired orientation of the target sheet here of the above-noted embodiment A. The weighted member 28 is mounted onto the upright rod 35 by the mounting brackets 36, and optionally has a cut-out or shaped-outline 28*a* providing space for functioning of a wheel and axle thereof mounted on the bottom of the rod 35 such that by leaning the rod 35, the rod 35 may be utilized as a handle for rolling the entire apparatus along the floor 38 to another desired location for use or for storage.

FIG. 8 illustrates an embodiment such as shown in the preferred embodiment of FIG. 4, except here including as a part of one or more of the first and second plastic sheet members 9''''' and/or 14' (not shown, but otherwise the same as 14, 9 or 9'''''), with the above-noted envelope 39 having a sealed enclosure enclosing a gas such as preferably a compressed gas such as air, such that the potential injurious effect to a hand or foot normally present as a hazard to any person hand-striking and/or kicking a target, is substantially reduced by this enveloped typically mounted on the surface 10'' providing a cushioning effect, and typically mounted by mounting strip(s) 40.

An already readily-available plastic sheet-structure such as utilized in this invention as the elongated sheet member having the spaced-apart first plastic sheet 9 and the second plastic sheet 14 each mounted on and interconnected by the spaced-apart plastic flanges 11, is currently manufactured by a company named Corr-Pac International of East Brunswick, N.J.—the making of and existence of this elongated sheet member in and of itself not being the invention which in a preferred embodiment is a combination thereof of with other elements/members of the invention as claimed and as described above above for the Figures. Likewise, whereas the suction cups are an integral part of some embodiments of the invention, such cups are typically conventional and readily available from a company named Suction Cups Inc. of Greenpoint, N.Y. Likewise, rubber structure such as typically utilized in preferred embodiments such as for the inventively-shaped/fashioned rigid support member 16 illustrated in FIG. 4, is readily commercially available and manufactured by a company named The Rubber Group of Belleville, N.J. Adhesive composition and/or layer(s) utilizable within the scope of this invention for attaching intermittently and/or permanently, may be any of conventionally available adhesive(s) suitable for the particular function desired, being readily available commercially, and/or includes appropriate latex sticky compositions and/or other synthetic stick rubber(s) and/or resin known and commercially available or otherwise provided or available.

Accordingly, the hand-gripping structure of embodiments A and B enable a person to more safely and securely hold the target-composit (combination) at any desired height, orientation (slant) or the like, for the practice striking with typically either the hand(s) and/or the foot/feet in typically karate kicks. Alternatively, the embodiments C, D and E provide other stable mechanisms of support, thereby totally avoiding any risk to others because human holders are not required. Yet, the embodiments C, D and E typically for this invention, provide at-least equal benefits obtained by human holders, together with many other advantages as set-forth above, particularly in the aforestated objects. It will be appreciated to those skilled in the art, with respect to embodiments C, D, and E, that the target member, in response to blows, will flex at the sheet member, and the suction cup neck members without the cups detaching from their secured position. In addition, an advantage of the invention includes that the target may be placed at any position due to the presence of the base, suction cups and other disclosed hardware.

It is within the scope of the invention to make such variations and modifications and substitution of equivalents as would be apparent to and with the skill of an ordinary artisan.

I claim:

1. A striking apparatus for use as a martial arts target comprising:

a multilaminated target sheet having a width and length sized to receive blows from a users foot or arm and flex in response thereto;

a rigid support member to which one edge of said sheet is secured;

a pair of suction cups having axially extending means engaging said support member at spaced positions on the side to which said sheet is secured, said suction cups shaped to simultaneously engage a flat surface at any one of a plurality of positions;

said apparatus adapted to flex at said sheet and at said axially extending means in response to blows on said sheet when said cups are adhered to a flat surface;

said multilaminated sheet being formed with an aperture adjacent said rigid support member forming a hand grip for use when said suction cups are not engaging a flat surface.

2. A striking apparatus as set forth in claim 1 wherein said axially extending means includes cylindrical members extending from the center of said cups.

3. A striking apparatus as set forth in claim 2 wherein said laminated target sheet comprises a pair of facing sheets spaced apart and flange means integral with and interconnecting the facing surfaces of said facing sheets.

4. A striking apparatus as set forth in claim 3 including a base having a diameter greater than the distance between said suction cups and a flat surface to which said cups may adhere.

5. A striking apparatus as set forth in claim 4 having means adapted to secure the surface opposite said flat surface to a supporting member.

6. A striking apparatus as set forth in claim 5 wherein the length of said sheet is greater than the distance between said suction cups.

7. A striking apparatus as set forth in claim 1 wherein said sheet is formed of a pair of facing sheets spaced apart and flange means integral with and interconnecting the facing surfaces of said facing sheets, the length of said sheets being greater than the distance between said suction cups and wherein said sheet includes an aperture adjacent the rigid support member forming a hand grip for use when said suction cups are not engaging a flat surface;

said axially extending means comprising cylindrical members extending from a convex surface of said cups at the one ends and engaging said rigid support member at the other ends; and a base having a diameter greater than the distance between said suction cups with one flat surface to which the cups may be adhered and a second opposite surface upon which said apparatus may be supported with means on said second opposite surface adapted to secure said base to a wall or floor.

* * * * *